United States Patent [19]

Kille et al.

[11] Patent Number: 4,511,074

[45] Date of Patent: Apr. 16, 1985

[54] ELECTRICALLY-OPERATED MANUAL DEVICE

[75] Inventors: Ewald Kille; Heinrich Griebel, both of Friedrichshafen, Fed. Rep. of Germany

[73] Assignee: J. Wagner GmbH, Friedrichshafen, Fed. Rep. of Germany

[21] Appl. No.: 393,661

[22] Filed: Jun. 30, 1982

[30] Foreign Application Priority Data

Jul. 1, 1981 [DE] Fed. Rep. of Germany ..... 3125860

[51] Int. Cl.[3] ..... B25C 1/06

[52] U.S. Cl. ..... 227/113; 227/131; 227/120; 279/1 T

[58] Field of Search ..... 227/113, 120, 131, 156; 279/9 R, 1 T

[56] References Cited

U.S. PATENT DOCUMENTS

| | | | |
|---|---|---|---|
| 2,999,646 | 9/1961 | Wagner | 239/332 |
| 3,116,879 | 1/1964 | Wagner | 239/332 |
| 3,203,610 | 8/1965 | Farrell | 227/131 X |
| 3,366,302 | 1/1968 | Blicharski | 227/131 |
| 3,552,627 | 1/1971 | Moreno | 227/131 X |
| 3,979,040 | 9/1976 | Denin | 227/113 |
| 4,160,525 | 7/1979 | Wagner | 239/332 |

FOREIGN PATENT DOCUMENTS

| | | | |
|---|---|---|---|
| 2938206 | 8/1979 | Fed. Rep. of Germany . | |
| 1290830 | 3/1962 | France | 227/131 |
| 805125 | 12/1958 | United Kingdom | 227/131 |
| 1386810 | 3/1975 | United Kingdom | 227/131 |

*Primary Examiner*—Paul A. Bell

*Attorney, Agent, or Firm*—Hill, Van Santen, Steadman & Simpson

[57] ABSTRACT

An electrically-operated manual device, such as a nail driver, has an electric motor for actuating an axially-movable impact body. The motor is a vibrating armature AC motor having a single-sided movably arranged vibrating armature which, in dependence of the power supply frequency, acts with a high impact frequency on a low-mass impact body. The impact body is located in a stationary cylinder connected to a housing of the device and has a detachable adapter sleeve which receives a plunger activated via the impact body on a part to be driven. The configuration of the device makes it possible to construct a nail driver or the like with an extremely compact structure since the cylinder equipped with the impact body can be arranged immediately adjacent the vibrating armature AC motor. The power losses are negligible because the vibrating armature, swinging about an axis, acts directly on the low-mass impact body. In addition, it is possible to construct adapter sleeves for connection to the cylinder for different driving applications.

24 Claims, 8 Drawing Figures

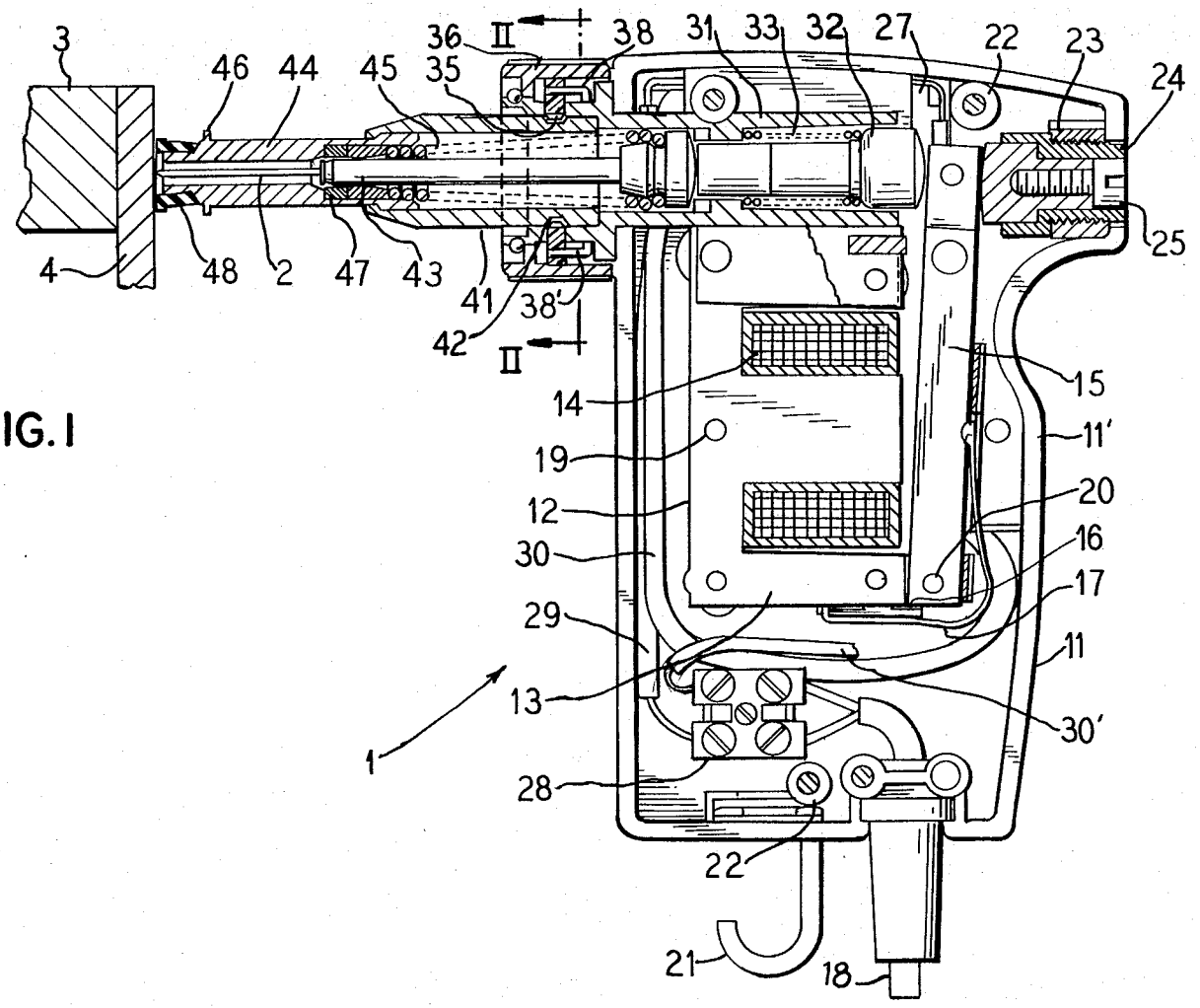
FIG. I

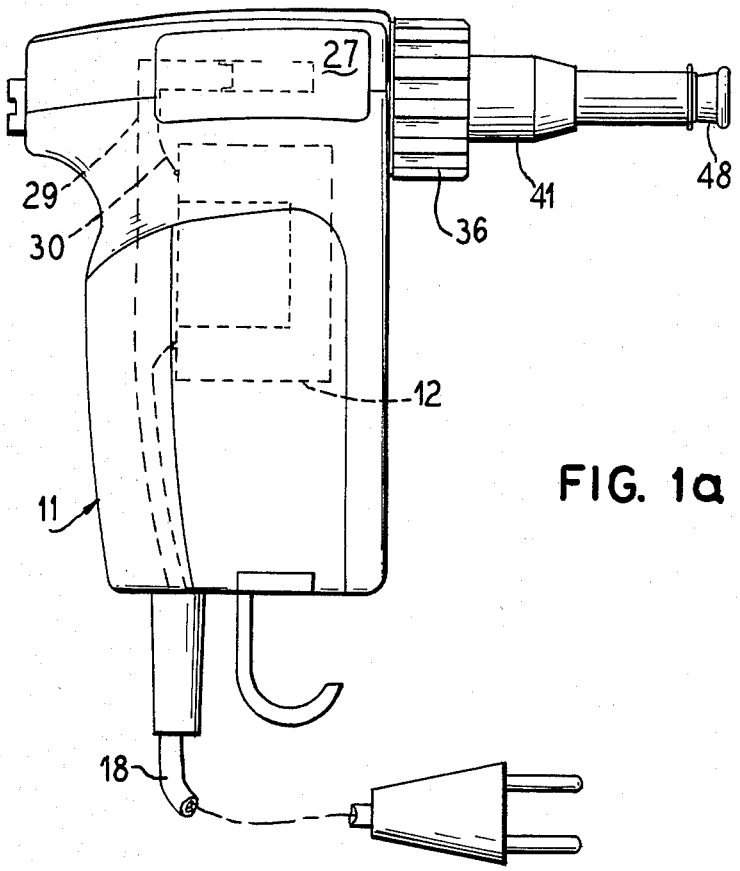
FIG. 1a
FIG. 2
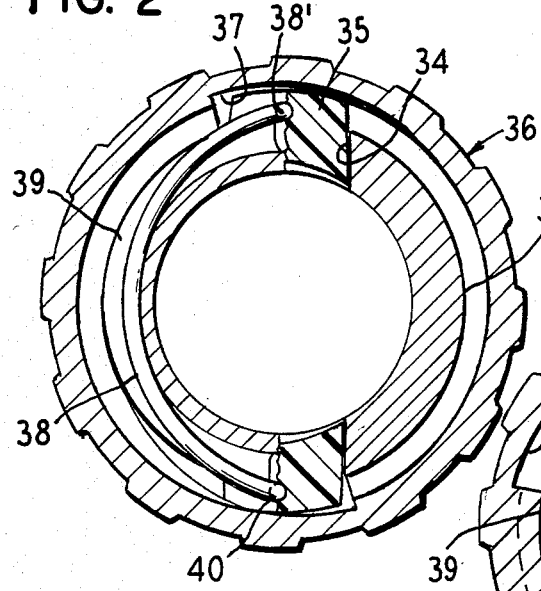
FIG. 2a
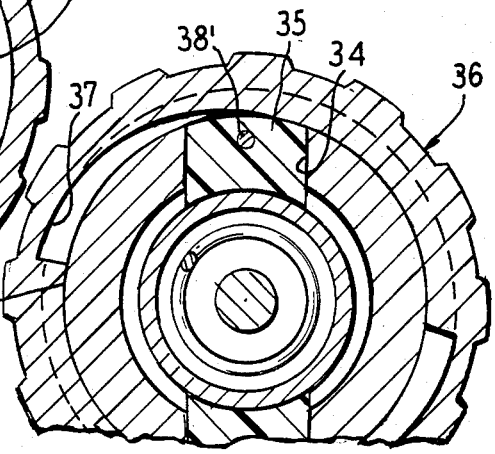

ELECTRICALLY-OPERATED MANUAL DEVICE

BACKGROUND OF THE INVENTION

1. Field of the Invention

The present invention relates to an electrically-operated manual device, in particular to a nail driver, having an axially-movable impact body which is actuated by an electric motor.

2. Description of the Prior Art

A motor-driven device of the general type mentioned above is known through the German published application No. 29 38 206. The impact structure, comprising an axially-movable cylinder and an axially-displaceable piston within the cylinder, is driven by a rotating electric motor, which is connected by a planet gear of special construction with the motor-driven portion of the impact structure. The structure of this hammer is to be short in comparison to other heretofore known hand tools. The manufacture, however, requires great expense since the rotating movement of the electric motor must be converted into the linear stroke type of movement of the axially-movable parts of the impact structure. In addition, the efficiency of such a drive is disadvantageous and the drive requires a relatively large space so that the hammer can be used as a manual device only with difficulty.

SUMMARY OF THE INVENTION

It is, therefore, the object of the present invention to provide an electrically-operated manual device, small in size, being extremely handy and light-weight and which is versatile with respect to the use thereof.

An attendant object of the invention is that the energy of the driving motor acts directly, without the interposition of other elements, on the impact body so that power losses are insignificant and a high efficiency is guaranteed at low manufacturing cost.

The above objects are realized, according to the present invention, in that the electric motor is formed as a swinging or pivoting armature AC motor having a single-sided vibrating armature, acting in dependence on the frequency of the power supply with a high impact frequency on a low-mass impact body. The impact body, operating at the frequency of the armature, is located in a stationary cylinder arranged in a housing of the device, to which an adapter sleeve can be detachably mounted, which adapter sleeve receives a plunger acting on a part or tool to be rammed in, the plunger being movable through the impact body against the adapter sleeve.

This configuration makes it possible to construct an extremely compact and lightweight manual device, since the cylinder provided with the impact body can be arranged immediately adjacent the vibrating armature AC motor, which for instance is known from paint spraying guns. Since the armature, attracted by the electromagnetic forces and swinging preferably with twice the frequency of the power supply about an axis of the vibrating magnet, is acting with its free end directly on the low mass impact body, the power losses which arise are extremely low. The device can easily be held in one hand for driving a nail or for riveting operations.

Since adapter sleeves of different configurations can be connected to the cylinder for various applications, a versatile application, as well as a quick change of working processes, is possible.

By using a vibrating armature AC motor as a driving member, which is extremely reliable, the device constructed in accordance with the present invention cannot only be manufactured very economically, but it is furthermore resistant against disturbances and is easy to handle, especially for overhead jobs.

It is of further advantage to support the impact body by a readjusting spring in the cylinder against the feed movement of the vibrating armature. This ensures that the impact body is always adjacent to the armature, so that the impact body is accelerated not by the impact of the vibrating armature, but by its feed movement, thus reducing impact noise.

The stroke of the vibrating armature can be adjusted easily by a counter bearing, preferably interacting with the free end of the armature and adjustably insertable into the housing of the device, for instance in the form of a threaded spindle which is screwed into a nut and which is provided with a buffer.

For connection of the adapter sleeve to the cylinder which receives the impact body, it is recommended to insert into the same one or several clamping pieces, which by a movable sleeve overlapping the free end of a cylinder projecting from a housing of the device are displaceable radially inwardly against a spring force and insertable into an annular groove which is incorporated in the adapter sleeve.

The clamping pieces are movably guided in two grooves incorporated in the cylinder and arranged diametrically opposite to each other and retained by a semicircular curved pressure spring which is supported by the grooves, whereby the spring is guided in a groove incorporated in the cylinder and is, by axially-directed shoulders formed at the ends, supported in bores provided in the clamping pieces, and for actuating the clamping pieces, the sleeve, overlapping the same, should be provided on its inner wall surface with eccentrically-extending pressure or inclined surfaces, which are associated with the clamping pieces.

A guide bush may be inserted into the adapter sleeve connected to the cylinder for receiving, for example, nails, rivets or the like, the guide bush being displaceable against the same and against the force of a spring supported at the plunger, the adjusting movement being limited by a stop which interacts with the adapter sleeve.

To lock the part to be rammed in, an annular permanent magnet can be inserted into the guide bush, and should furthermore be provided at its free end with a packing or similar structure made of elastic ductile material, in order to avoid damage of the workpieces to be treated.

According to another configuration, the plunger can be supported at the adapter sleeve by a spring and can be provided with a laterally-protruding magazine for receiving clamps, nails and the like, the plunger being guided axially against the force of a spring in the adapter sleeve and provided with a receiving channel into which a tongue of the plunger is inserted, whereby the tongue remains in the receiving channel while the clamp, nail or the like is rammed in.

Furthermore, it is possible to support the plunger at the adapter sleeve by a spring and to insert an axially-movable tool into the same, for example a chisel or the like.

The adapter sleeve, provided with the magazine or the tool, can furthermore be inserted in a positionally-oriented manner, for instance by a polygonal shape, into the cylinder thus ensuring an accurate alignment.

In order to facilitate the operation of the device, it is recommended to provide the housing of the device with a suspension arrangement, preferably in the area of the entrance of an electric connection line, for example in the form of a punched hook incorporated in the housing, and to switch the vibrating armature AC motor on and off by a switch arranged, preferably, as a tiltable plate in the area of the impact body in one of the shells of the housing.

BRIEF DESCRIPTION OF THE DRAWINGS

Other objects, features and advantages of the invention, its organization, construction and operation will be best understood from the following detailed description, taken in conjunction with the accompanying drawings, on which:

FIG. 1 is a sectional view of a manual device constructed in accordance with the invention and having an adapter sleeve for ramming in nails;

FIG. 2 is a sectional view taken along the parting line II—II of FIG. 1 and shown in an enlarged scale;

DESCRIPTION OF THE PREFERRED EMBODIMENTS

Figure 3:
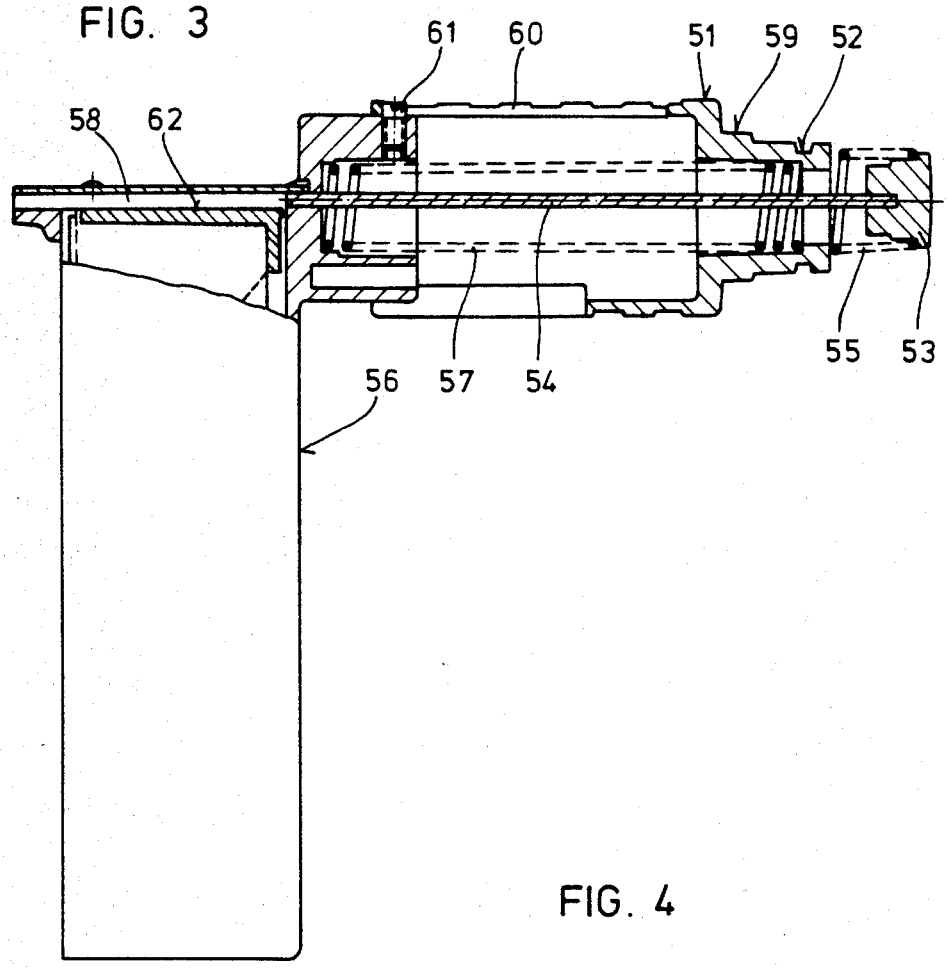
FIG. 3 is a fragmentary sectional view of an adapter sleeve, provided with a magazine for receiving clamps or the like, and connectible to the manual device of FIG. 1.

An electrically-operated manual device, constructed in accordance with the present invention, is illustrated in FIG. 1 and is generally referenced 1. The device is employed for ramming, for example, nails 2 into wood parts 3 and 4 and primarily comprises a vibrating armature AC motor 12 disposed in a two-piece housing 11, and a cylinder 31 also located in the housing 11, the cylinder 31 having an impact body 32 therein. The vibrating armature AC motor 12 comprises a stator 13 having a magnetic coil 14 which is connectible to an electric supply source by way of a line 18. In addition, the motor 12 comprises a vibrating armature 15 which is held at one end by an angular curved plate spring 17, the armature being pivotal about an edge 16 by the force of the spring and by the force of a magnetic field generated by the magnet coil 14. The stator 13 comprises a plurality of E-shaped sheets, and the armature 15 comprises a plurality of sheets, which sheets are held together by rivets 19 and 20, respectively.

The housing 11, which comprises two housing shells, of which only one is illustrated at 11', comprises a suspension device 21, by means of which the device 1 can be held easily in different manners with pins or ropes. In addition, the shell 11' is equipped with fastening eyes 22 which receive screws for securing the shell 11 to the shell 11' (not shown). Furthermore, a tiltable or rocker plate 27 is located in the shell 11' in the area of the impact body 32 for actuating a switch (not shown) through which a pair of lines 29 and 30 are connectible with each other via the vibrating armature AC motor 12. The current circuit is therewith closed via the lines 29, 30 and 30', during operation, whereby the lines 29 and 30' are connected to the current supply line 18 by way of a terminal board 28.

In order to adjust the stroke of the vibrating armature 15, a nut 23 is located in the housing shell 11', which receives a threaded spindle 24. The spindle 24 is equipped with a rubber buffer 26, against which the vibrating armature 15 is pressed by the force of a readjusting spring 33. With the aid of a screwdriver or similar tool, which can be inserted into a slot 25 in the threaded spindle 24, the spindle 24 can be turned easily and, consequently, the stroke of the vibrating armature 15 can be changed.

With the stationarily-held cylinder 31, into which the axially-movable impact body 32 is arranged for movement against the force of the readjusting spring 33, an adapter sleeve 41 is connected as illustrated in FIG. 1, in which a plunger 43 and a guide bush 44 are received. The guide bush 44 is inserted, movable, in the adapter sleeve 41 against the force of a spring 45 and is supported by the plunger 43 which operates as a driver. A stop ring 46 limits the rearward movement of the guide bush 44 which receives a nail 2 to be rammed in. In addition, a packing element 48 is applied to the free end of a guide bush 44 to avoid damage to the wood part 4 when the device 1 is placed thereagainst. In order to hold the nail 2 and the guide bush 44 in a simple manner, the guide bush 44 is provided with an annular permanent magnet 47.

For connection of the adapter sleeve 41 with the cylinder 31, as illustrated in detail in FIG. 2, diametrically arranged clamping pieces 35 are provided and are radially movable in grooves 34 incorporated in the cylinder 31 against the force of a semicircular spring 38. The spring 38 has ends 38' which engage in bores 40 provided in the clamping pieces 35. In addition, the spring 38 extends in a groove 39 of the cylinder 31.

For the radial displacement of the clamping pieces 35, a sleeve 36 is arranged for rotation on the free end of the cylinder 31 and is equipped with eccentric cams 37. If the sleeve 36, according to FIG. 2, is turned counterclockwise, the clamping pieces 35 are moved against the force of the spring 38 by the cams 37 of the sleeve 36 inwardly, so that they engage with a circular groove 42 incorporated in the adapter sleeve 41. In this manner, the adapter sleeve 41 is firmly connected with the cylinder 31 since the clamping pieces 35 are pressed into the cylinder 31. Nevertheless, the connection can be easily released by clockwise rotation of the sleeve 36. By force of the spring 38, the clamping pieces 35 are pressed outwardly as soon as a corresponding free space is available through the clockwise rotation of the sleeve 36.

If, as illustrated in FIG. 1, a nail 2 is inserted into the guide bush 44 and the vibrating armature AC motor 12 is switched on, the vibrating armature 15 is moved by the magnetic field built up at twice the frequency of the power supply towards the stator 13. The attracting force, hereby exerted on the vibrating armature 15, is transferred to the impact body 32, acting on the plunger 43, through which the nail 2 is rammed into the wood parts 3 and 4. Consequently, the device 1 is immediately ready for operation, no large masses have to be accelerated, the drive force of the vibrating armature motor 12 is transferred immediately to the nail 2 to be driven.

Figure 4:
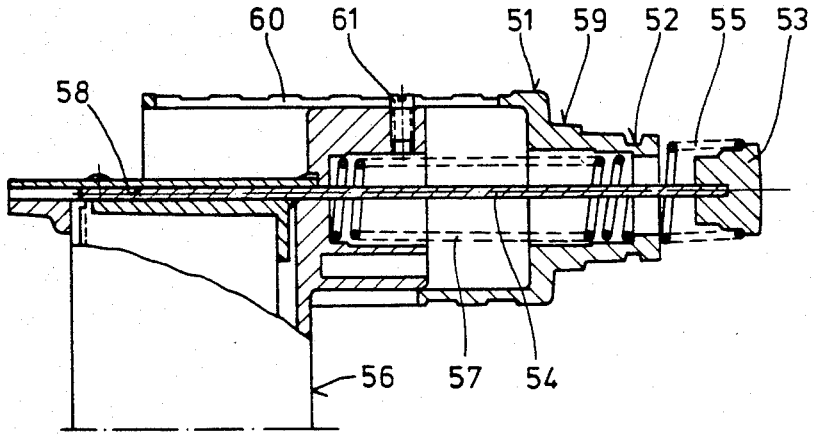
FIG. 4 is a partial fragmentary view of the adapter sleeve of FIG. 3 during operation.

According to FIGS. 3 and 4, a plunger 53 is located within the adapter sleeve 51 which has an annular groove 52 for receiving the clamping pieces 35, and the structure is equipped with a magazine 56 for receiving clamps, nails and the like which can be driven by a tongue 54, which operates as a nail driver, connected with the plunger 53. The plunger 53 is supported by a spring 55 at the adapter sleeve 51, at which, furthermore, the magazine 56 is also supported by a spring 57.

For the non-movable mounting of the magazine 56 at the adapter sleeve 51, the same is equipped with a slot 60 which receives a screw 61, projecting from the magazine 56. In addition, a polygonal periphery 59 is arranged on the adapter sleeve 51 to interact with a similar polygonal structure formed in the cylinder 31. In this manner, the magazine 56 can be inserted, in an accurate alignment, into the device 1.

The clamps, nails and the like stored in the magazine 56 are, as illustrated in FIG. 3, inserted one after the another by a spring-loaded slider 62 into a channel 58 and driven by the tongue 54. As long as the tongue 54 remains the channel 58 (FIG. 4) it is impossible for a clamp, nail or the like to be pushed forward (upwardly on the drawing).

Figure 5:
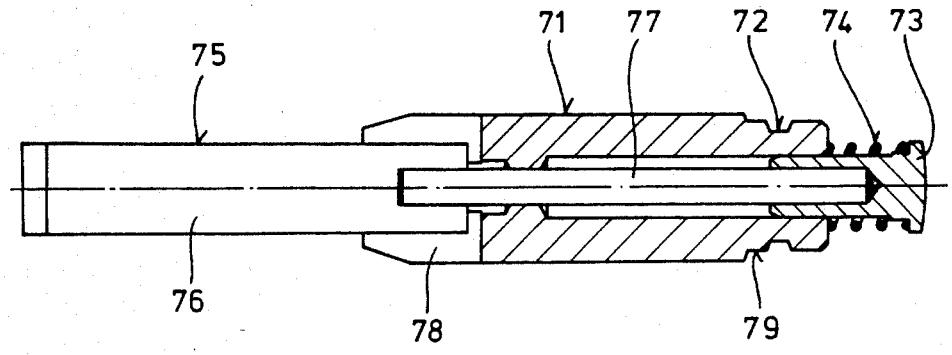
FIGS. 5 and 6 are respective sectional views of a further adapter sleeve with a tool and connectible to the manual device of FIG. 1.
Figure 6:
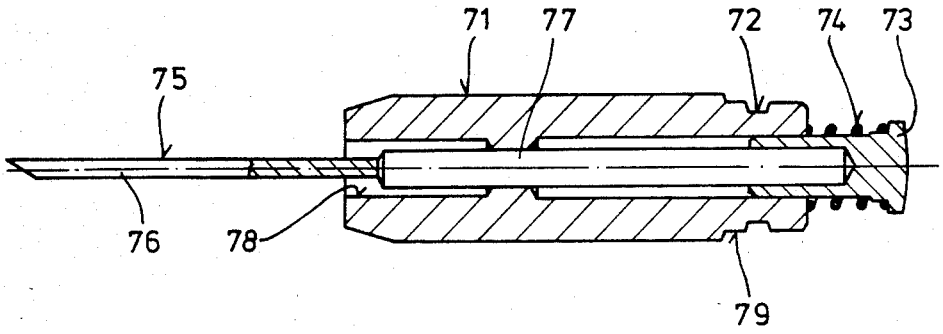

In FIGS. 5 and 6, an adapter sleeve 71 is provided in the same manner with an annular groove 72 and a polygonal structure 79 for positional orientation and mounting in the cylinder 31 of the device 1. The adapter sleeve 71 receives a tool 75, here a chisel. The blade 76 of the tool 75 engages in a slot 78 of the adapter sleeve 71 and is provided with a bolt 77 which is inserted into a plunger 73. By way of a spring 74, the plunger 73, driven by the impact body 32, is supported at the adapter sleeve.

With the adapter sleeve 71 inserted into the cylinder 31, it is possible to easily perform chisel jobs with the tool 75, since the same is driven by the impact body 32, which, in turn, is actuated by the vibrating armature 15 and returned rearwardly by the action of the spring 74.

Although we have described our invention by reference to particular illustrative embodiments thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. A vibratory impact driving device comprising:
support means including a front and a rear;
a forwardly extending rearwardly biased, impact body supported by said support means;
element holding means supported by said support means for holding an element to be driven;
means defining at least one groove in said element holding means;
a rotatably mounted ring on said support means;
at least one clamping device within said ring;
a spring within said ring and connected to said clamping device and urging the same away from said groove;
at least one cam surface on said ring for camming said clamping device into said groove upon rotation of said ring;
a pivotally mounted member including a free end adjacent said impact body; and
drive means supported by said support means and operable to vibrate said member against said impact body and cause the same to repetitively strike the element to be driven.

2. An electrically-operated impact-type driving device comprising:
a housing;
an electrically-energized AC motor including a stator mounted in said housing and operable to produce an AC magnetic field, and a spring-biased pivotally-mounted armature having a free end and operable to pivot towards and away from said stator;
a hollow cylinder connected to said housing;
an impact body, including a plunger for engaging an element to be driven, spring biased and axially movable in said cylinder; and
a hollow adapter sleeve detachably mounted to said cylinder for receiving an element to be driven, said adapter sleeve receiving said plunger therethrough for engagement with the element to be driven;
means defining at least one groove in said adapter;
a rotatably mounted ring on said cylinder;
at least one clamping device within said ring;
a spring within said ring and connected to said clamping device and urging the same away from said groove; and
at least one cam surface on said ring for camming said clamping device into said groove upon rotation of said ring.

3. The device of claim 2, and further comprising:
a rearward facing shoulder in said cylinder;
a forward facing shoulder on said impact body; and
a compression spring bearing against said rearward and forward facing shoulders.

4. The device of claim 2, further comprising
a threaded bore in said housing;
counterbearing means for engaging said armature, including a threaded spindle adjustably received in said threaded bore and a buffer on said spindle for engaging said armature.

5. The device of claim 4, further comprising:
a threaded nut mounted in said housing and constituting said threaded bore.

6. The device of claim 2, wherein:
said means defines a pair of diametrically-opposite grooves;
a pair of clamping devices are located within said ring;
a pair of cam surfaces are located on said ring; and
said spring is a semicircular spring having a pair of ends each connected to a respective clamping device.

7. The device of claim 2, and further comprising:
means defining a further groove in said cylinder receiving said spring therein.

8. The device of claim 2, wherein:
said clamping device comprises connection means for receiving an end of said spring; and
said spring comprises a circular spring including an end which extends axially of said cylinder and is received in said connection means.

9. The device of claim 2, and further comprising:
a hollow guide bush, for receiving an element to be driven and for receiving said plunger, disposed within and axially movable within said adapter; and
a spring normally biasing said guide bush forwardly out of said adapter, said guide bush including a rearwardly facing shoulder engaging said spring and said impact body including a forwardly facing shoulder engaging said spring.

10. The device of claim 9, and further comprising:
a forward end on said guide bush; and an annular permanent magnet about said forward end for holding an element to be driven.

11. The device of claim 9, and further comprising:

a forward end on said guide bush; and an anti-mar device of elastic ductile material on said forward end.

12. The device of claim 9, and further comprising:

a stop element on said guide bush for engaging said adapter and limiting rearward movement of said guide bush.

13. The device of claim 2, wherein the element to be driven is a tool, and further comprising:

means on said plunger for releasably receiving a tool to be driven.

14. The device of claim 2, and further comprising:

a magazine, for holding a plurality of elements to be driven, coupled to said adapter, said magazine including a channel for receiving an element to be driven and said plunger, and a rearwardly facing shoulder;

said adapter receiving said magazine therein and including a forwardly facing shoulder; and a spring bearing against said shoulders and urging said magazine forwardly, said plunger comprises a forward end which remains within said channel during driving.

15. The device of claim 2, wherein:

said adapter comprises a shaped peripheral section; and said cylinder comprises a complementary shaped section for positional orientation of said adapter with respect to said cylinder.

16. The device of claim 15, wherein:

said shaped sections are polygonal.

17. The device of claim 2, wherein:

said housing comprises a support hook.

18. The device of claim 2, and further comprising:

a power cord for connecting said motor to a power supply; and an on-off switch mounted in said housing and electrically connected between said motor and said power cord.

19. An electrically-operated impact-type driving device comprising:

a hollow housing including at least two housing shells connected together and defining a hollow handle, a forward end and a rear end;

a vibrating AC motor mounted in said handle and including a fixed stator and a pivotally mounted armature having a free end;

a power cord extending through said housing for connection to a power supply;

an on-off switch mounted in one of said housing shells and connected between said stator and said power cord;

a hollow cylinder extending through said forward end of said housing and including a first and second forward facing shoulder and a rearward facing shoulder;

a hollow adapter mounted within said cylinder for axially receiving said plunger, said adapter including a first rearwardly facing shoulder engaging said first forwardly facing shoulder, a second rearwardly facing shoulder and a pair of diametrically opposite peripheral grooves;

locking means on said cylinder including a rotatable ring, a pair of diametrically opposite cam surfaces on said ring, and a pair of spring-loaded clamping devices for movement into and out of said grooves in response to rotation of said ring;

a hollow guide bush for receiving an element to be driven, said guide bush including a forward end for engaging a workpiece, and a forwardly facing shoulder for engaging said second rearwardly facing shoulder of said adapter;

an impact body mounted in said cylinder for axial movement, including a plunger for extending through said adapter and said guide bush to engage an element to be driven, first and second forwardly facing shoulders, and a rear end positioned to be struck by said armature;

a first spring engaging said forwardly facing shoulder of said guide bush and said first forwardly facing shoulder of said impact body for urging said guide bush forwardly with respect to said device; and a second spring engaging said second forwardly facing shoulder of said impact body and said rearwardly facing shoulder of said cylinder to urge said impact body towards said armature.

20. The electrically-operated driving device of claim 19, wherein:

said on-off switch comprises a tiltable actuating plate.

21. The device of claim 19, and further comprising:

a stop element carried on said guide bush for engaging the forward end of said adapter and limiting rearward movement of said guide bush.

22. The device of claim 19, and further comprising:

a permanent magnet carried by said guide bush for holding an element to be driven.

23. The device of claim 19, and further comprising:

an element of elastic material carried on the forward end of said guide bush.

24. A vibratory impact driving device comprising:

a housing including a front and a rear;

a forwardly facing hollow cylinder supported by said housing;

an impact body slidably mounted in said cylinder for axial movement therein;

a spring in said cylinder engaging and biasing said impact body rearwardly;

hollow sleeve means supported by said cylinder in alignment with said impact body for receiving an element to be driven;

means defining at least one groove in said hollow sleeve means;

a rotatably mounted ring on said cylinder;

at least one clamping device within said ring;

a spring within said ring and connected to said clamping device and urging the same away from said groove;

at least one cam surface on said ring for camming said clamping device into said groove upon rotation of said ring; and a motor mounted in said housing including a vibratory pivotally mounted member for driving said impact body forward against the bias of said spring to strike the element.

* * * * *